US009415494B2

(12) United States Patent
Sokol et al.

(10) Patent No.: US 9,415,494 B2
(45) Date of Patent: Aug. 16, 2016

(54) FASTENING TOOL ASSEMBLY

(71) Applicant: Arrow Fastener Co., LLC, Saddle Brook, NJ (US)

(72) Inventors: Jonathan Sokol, New York, NY (US); Gregg Malanga, Wayne, NJ (US)

(73) Assignee: Arrow Fastener Co., LLC, Saddlebrook, NJ (US)

( * ) Notice: Subject to any disclaimer, the term of this patent is extended or adjusted under 35 U.S.C. 154(b) by 713 days.

(21) Appl. No.: 13/834,951

(22) Filed: Mar. 15, 2013

(65) Prior Publication Data

US 2014/0263536 A1 Sep. 18, 2014

(51) Int. Cl.
*B25C 5/11* (2006.01)
*B25C 5/16* (2006.01)

(52) U.S. Cl.
CPC . *B25C 5/11* (2013.01); *B25C 5/162* (2013.01); *B25C 5/1613* (2013.01)

(58) Field of Classification Search
CPC ..... B25C 5/06; B25C 5/11; B25C 5/1613; B25C 5/1617; B25C 5/0221; B25C 5/162
USPC ..... 227/132, 129, 134
See application file for complete search history.

(56) References Cited

U.S. PATENT DOCUMENTS 1,446,107 A * 2/1923 Tibbals ..... B25C 5/0292 227/143
2,593,231 A * 4/1952 Wandel ..... B25C 5/06 227/132
3,586,231 A 6/1971 Wilson
3,610,505 A * 10/1971 Males ..... B25C 5/16 227/127
4,126,260 A * 11/1978 Mickelsson ..... B25C 5/10 227/132
4,206,863 A 6/1980 Savino
5,335,839 A * 8/1994 Fealey ..... B25C 5/11 227/132
5,979,736 A * 11/1999 Edeholt ..... B25C 5/11 227/132
6,386,418 B1 5/2002 Garner
7,118,019 B2 * 10/2006 Marks ..... B25C 5/0242 227/119
7,178,709 B2 * 2/2007 Marks ..... B25C 5/0242 227/107

(Continued)

FOREIGN PATENT DOCUMENTS

EP 1733848 A1 12/2006
WO 2008052456 A1 5/2008

OTHER PUBLICATIONS

European Search Report for corresponding Application No. 14159300.4, mailed Mar. 2, 2015, 9 pages.

*Primary Examiner* — Michelle Lopez
*Assistant Examiner* — Eduardo R Ferrero
(74) *Attorney, Agent, or Firm* — Brooks Kushman P.C.; Lora Graentzdoerffer

(57) ABSTRACT

A fastening tool assembly is provided with a housing having a contact surface to contact a workpiece. A magazine is mounted in the housing to store fasteners and to convey the fasteners to a fastener outlet. A knife is mounted in the housing for translation between a latched position and a release position to drive a fastener from the magazine through the outlet during translation to the release position. A biasing member is mounted in the housing and is operably connected to the knife to bias the knife to the release position. A handle is mounted to the housing to translate relative to the housing. The handle is operably connected to the knife and the biasing member to load the biasing member and release the knife and the biasing member, thereby permitting the biasing member to return the knife to the release position to drive a fastener through the outlet.

20 Claims, 9 Drawing Sheets

(56) References Cited

U.S. PATENT DOCUMENTS 7,234,621 B2 * 6/2007 Marks ..... B25C 5/0242 227/120
7,290,692 B2 * 11/2007 Marks ..... B25C 1/008 227/120
7,299,960 B1 * 11/2007 Marks ..... B25C 5/11 227/132
7,328,827 B2 2/2008 Marks
7,387,227 B1 6/2008 Jiang et al.
7,464,844 B2 * 12/2008 Kamins ..... B25C 5/10 227/120
7,571,840 B2 * 8/2009 Chen ..... B25C 5/11 227/10
7,604,149 B2 * 10/2009 Tsai ..... B25C 5/11 227/132
7,644,849 B2 * 1/2010 Tsai ..... B25C 5/11 227/129
7,669,745 B2 * 3/2010 Chang ..... B25C 5/025 227/107
7,681,771 B2 * 3/2010 Kandasamy ..... B25C 5/0242 227/120
7,708,179 B2 5/2010 Marks
7,909,218 B2 * 3/2011 Jiang ..... B25C 5/025 227/120
7,950,558 B2 * 5/2011 Marks ..... B25C 5/0292 227/120
7,980,438 B2 * 7/2011 Lin ..... B25C 5/0257 227/130
8,061,575 B2 * 11/2011 Joyce ..... B25C 5/11 227/120
8,113,404 B2 * 2/2012 Marks ..... B25C 5/11 227/132
2004/0238592 A1 * 12/2004 Shor ..... B25C 5/11 227/132
2007/0158384 A1 * 7/2007 Zins ..... B25C 11/00 227/132
2007/0175946 A1 * 8/2007 Marks ..... B25C 5/11 227/132
2007/0272721 A1 * 11/2007 Marks ..... B25C 5/0242 227/132
2008/0093413 A1 * 4/2008 Marks ..... B25C 5/11 227/132
2008/0223902 A1 * 9/2008 Tsai ..... B25C 5/11 227/134
2008/0308599 A1 * 12/2008 Marks ..... B25C 5/0242 227/132
2009/0114698 A1 * 5/2009 Marks ..... B25C 5/0292 227/132
2009/0159632 A1 6/2009 Jiang
2009/0218381 A1 * 9/2009 Holt ..... B25C 5/0214 227/76
2010/0108738 A1 5/2010 Cedar et al.
2011/0297725 A1 * 12/2011 Huang ..... B25C 5/11 227/120
2012/0111917 A1 * 5/2012 Popowich ..... B25C 5/11 227/126
2012/0118933 A1 * 5/2012 Zheng ..... B25C 5/1617 227/120
2014/0263536 A1 * 9/2014 Sokol ..... B25C 5/11 227/132

* cited by examiner

FASTENING TOOL ASSEMBLY

TECHNICAL FIELD

Various embodiments relate to fastening tool assemblies.

BACKGROUND

Various fastening tool assemblies require a large input force to load a spring, which consequently drives a fastener from the tool assembly.

SUMMARY

According to at least one embodiment, a fastening tool assembly is provided with a housing having a contact surface to contact a workpiece. A fastener outlet is provided along the contact surface to dispense fasteners therethrough. A magazine is mounted in the housing to store fasteners and to convey the fasteners to the fastener outlet. A knife is mounted in the housing for translation relative to the outlet for a latched position and a release position to drive a fastener from the magazine through the outlet during translation to the release position. A biasing member is mounted in the housing and is operably connected to the knife to bias the knife to the release position. A handle is mounted to the housing to translate relative to the housing. The handle is operably connected to the knife and the biasing member to load the biasing member and release the knife and the biasing member, thereby permitting the biasing member to return the knife to the release position to consequently drive a fastener through the outlet.

According to at least another embodiment, a fastening tool assembly is provided with a housing having a contact surface to contact a workpiece. A fastener outlet is provided along the contact surface to dispense fasteners therethrough. A magazine is mounted in the housing to store fasteners and to convey the fasteners to the fastener outlet. A knife is mounted in the housing for translation relative to the outlet for a latched position and a release position to drive a fastener from the magazine through the outlet during translation to the release position. A biasing member is mounted in the housing and operably connected to the knife to bias the knife to the release position. A handle is mounted to the housing to move relative to the housing. The handle is operably connected to the knife and the biasing member to load the biasing member and release the knife and the biasing member, thereby permitting the biasing member to return the knife to the release position to consequently drive a fastener through the outlet. A pair of inwardly converging ramp surfaces is formed upon the handle facing the housing. A pair of wedges engages the ramp surfaces and cooperates with the biasing member to converge as the handle is translated toward the housing. A third wedge engages the pair of wedges and the biasing member to translate toward the housing thereby loading the biasing member as the pair of wedges converge.

According to at least another embodiment, a fastening tool assembly is provided with a housing having a contact surface to contact a workpiece. A fastener outlet is provided along the contact surface to dispense fasteners therethrough. A magazine is mounted in the housing to store fasteners and to convey the fasteners to the fastener outlet. A knife is mounted in the housing for translation relative to the outlet for a latched position and a release position to drive a fastener from the magazine through the outlet during translation to the release position. The knife includes an aperture formed therethrough. A first biasing member is mounted in the housing and is operably connected to the knife to bias the knife to the release position. A handle is mounted to the housing to move relative to the housing. The handle is operably connected to the knife and the first biasing member to load the first biasing member and release the knife and the first biasing member, thereby permitting the first biasing member to return the knife to the release position to consequently drive a fastener through the outlet. A second biasing member biases the knife to a raised position. A latch member is pivotally connected to the housing with a catch extending into the knife aperture to retain the knife in the raised position. A cam portion is provided on the latch member spaced apart from the catch. A slider is mounted for translation in the housing in engagement with the latch member cam portion. The slider has an aperture formed therethrough. The slider cooperates with the handle so that depression of the handle translates the slider until the slider aperture aligns with the latch member cam portion whereby the latch member pivots as the cam portion extends into the slider aperture thereby releasing the catch from the knife thereby releasing the knife.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Prior art manual fastening tool assemblies utilize a pivoting handle, with levers to gain mechanical advantage for loading a spring and driving a fastener into a workpiece. Such tool assemblies are often designed for the greatest output required of that tool, such as a large gauge fastener and a hard workpiece. A range of pivoting of the handle is limited by hand grip sizes, thereby limiting a mechanical advantage of the tool. Pivoting handle fastening tool assemblies may be difficult for all people to operate, and may lead to fatigue after repeat usage.

Figure 2:
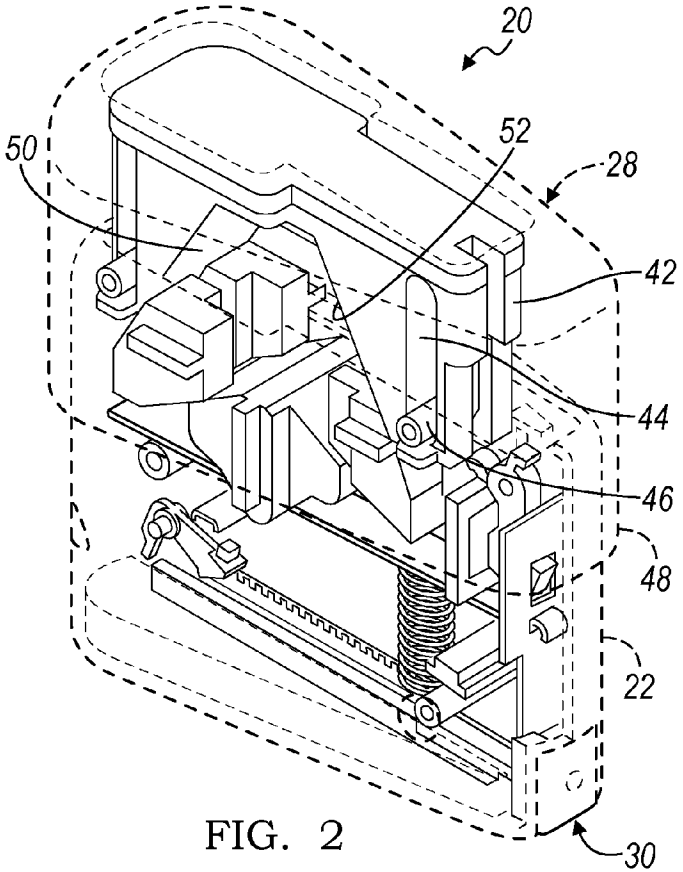
FIG. 2 is another front perspective view of the fastening tool assembly of FIG. 1.
Figure 1:
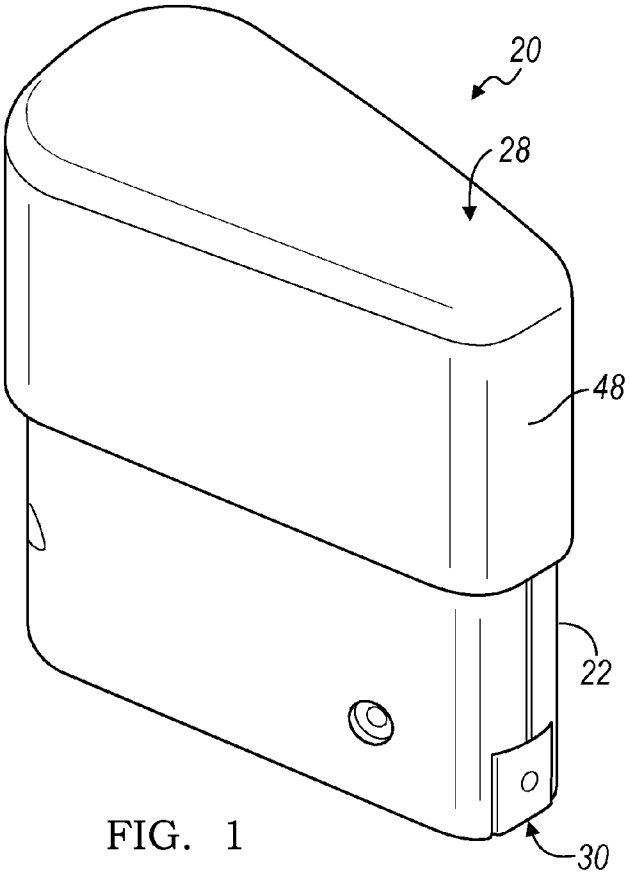
FIG. 1 is a front perspective view of a fastening tool assembly according to an embodiment.

Referring to FIGS. 1 and 2, a fastening tool assembly 20, such a staple gun, is illustrated according to an embodiment. The fastening tool assembly 20 includes a base housing 22 with a contact surface 24, which may be flat as depicted, for contacting a workpiece. A fastener outlet 26 (FIG. 3) is provided in the housing 22 to dispense fasteners individually from the housing 22. A handle 28 is mounted to the housing 22 to translate relative to the housing 22 to dispense fasteners from the outlet 26. Without a pivoting handle, a range of translation of the handle 28 is not limited by hand size; and therefore, the range can be designed for reduced input force upon the handle 28. The fastening tool assembly 20 only requires a pressing motion perpendicular to the workpiece wherein a user's body weight can be effectively utilized to help actuate the handle 28 toward the workpiece.

Figure 6:
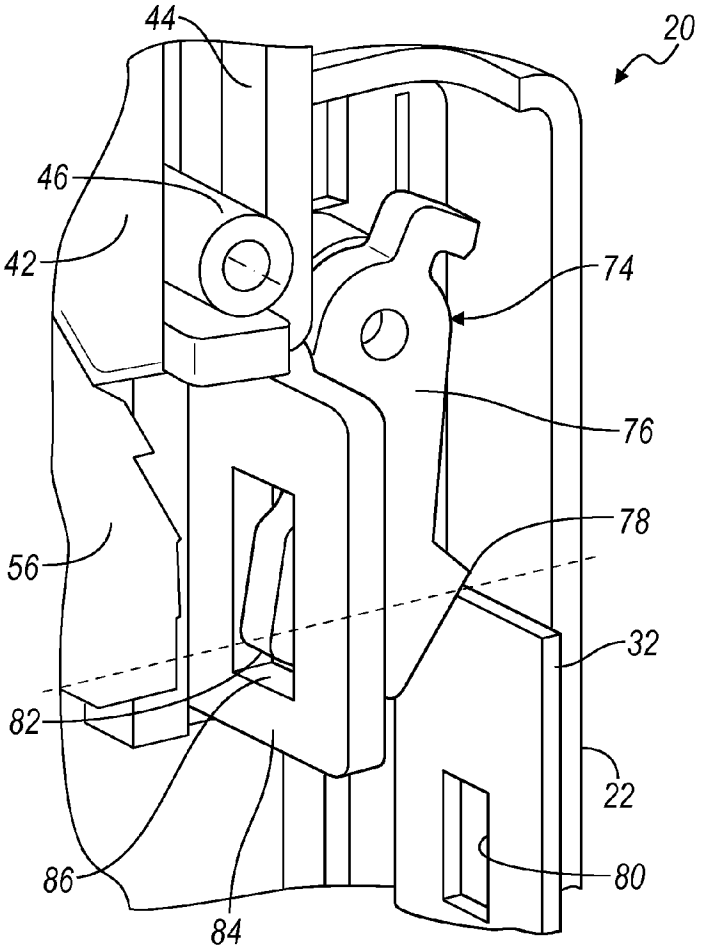
FIG. 6 is another enlarged perspective view of the release mechanism of FIG. 5, illustrated in a release position.
Figure 5:
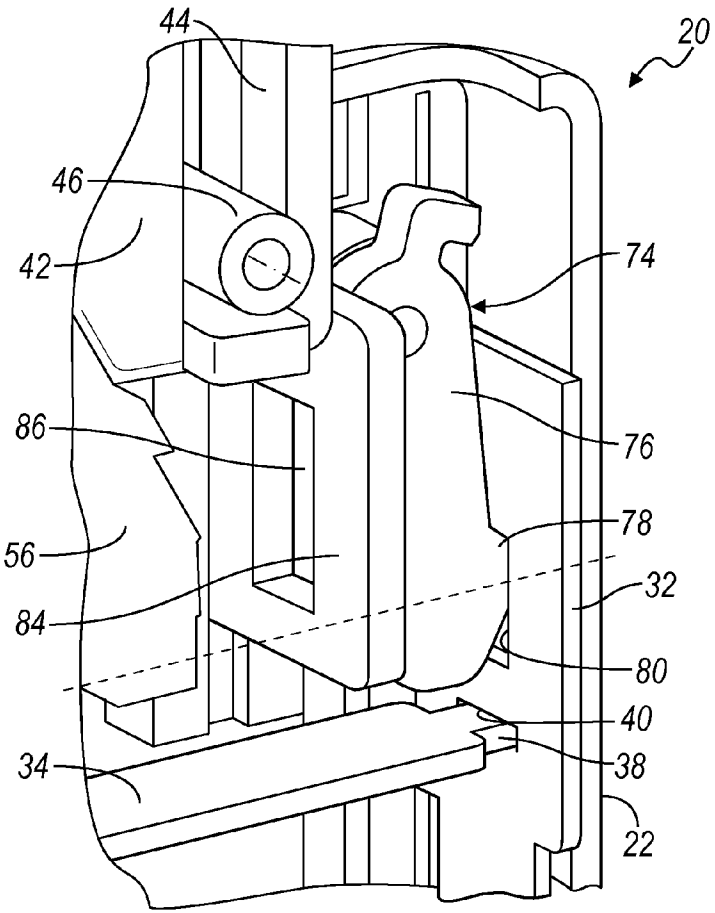
FIG. 5 is an enlarged perspective view of a release mechanism of the fastening tool assembly of FIG. 1, illustrated in a latched position.
Figure 7:
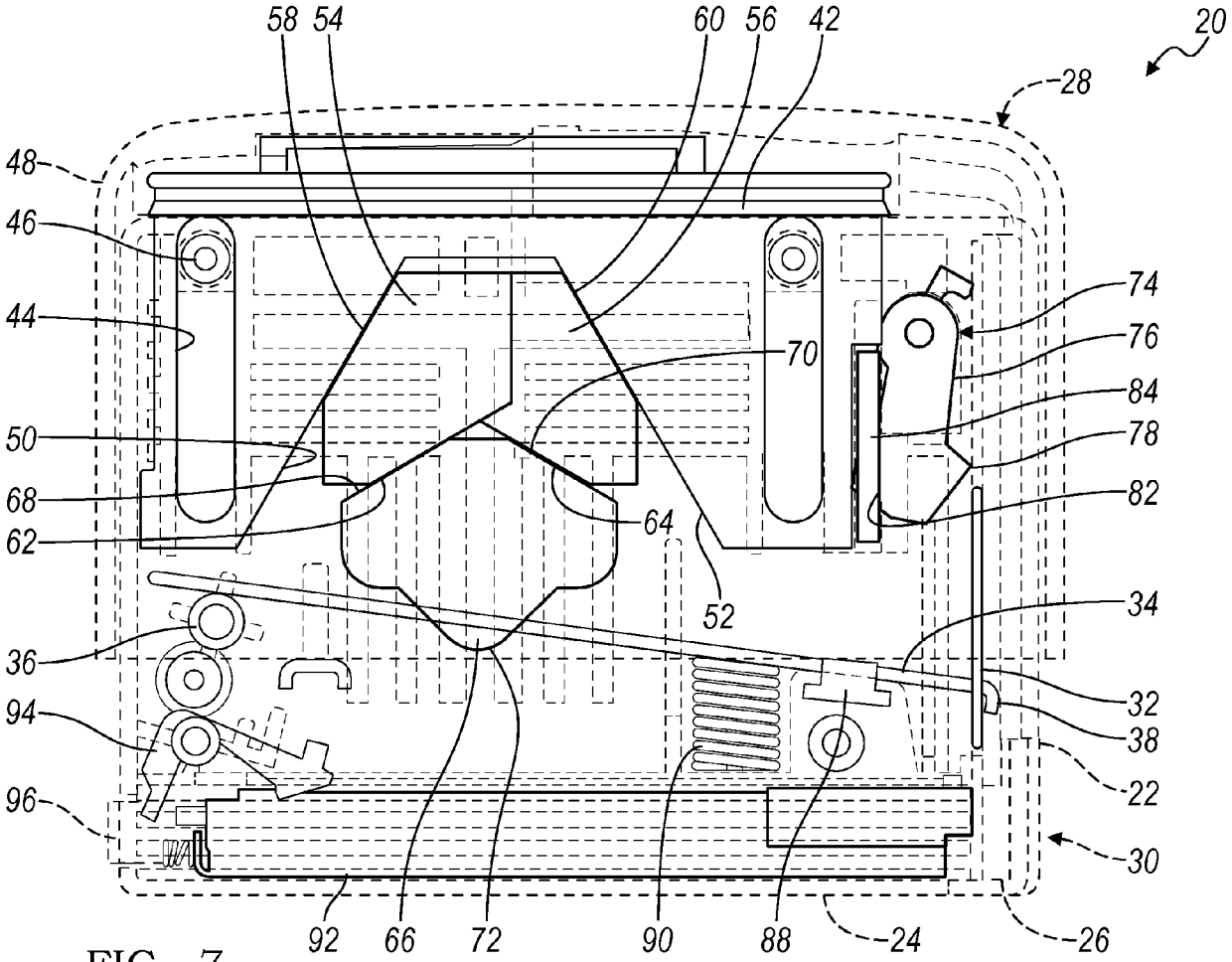
FIG. 7 is another section view of the fastening tool assembly of FIG. 1 illustrated in a release position.

The tool assembly 20 includes a magazine assembly 30 to store fasteners and to convey the fasteners to the fastener outlet 26. A knife 32 is mounted in the housing 22 for translation relative to the outlet for a latched position (FIGS. 2-5) and a release position (FIGS. 6 and 7). Translation to the release position drives a fastener from the magazine assembly 30 through the outlet 26.

Figure 3:
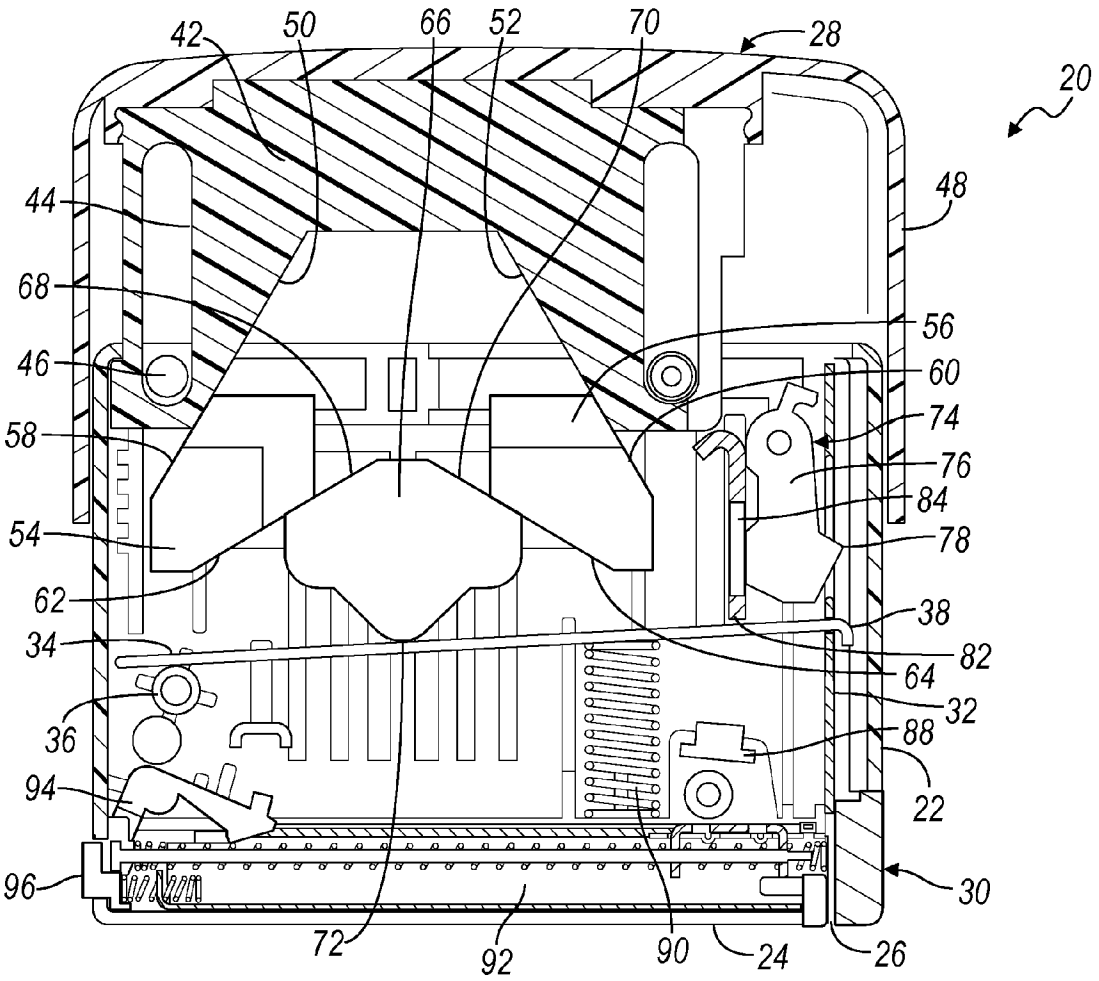
FIG. 3 is a section view of the fastening tool assembly of FIG. 1 illustrated in an unloaded position.
Figure 4:
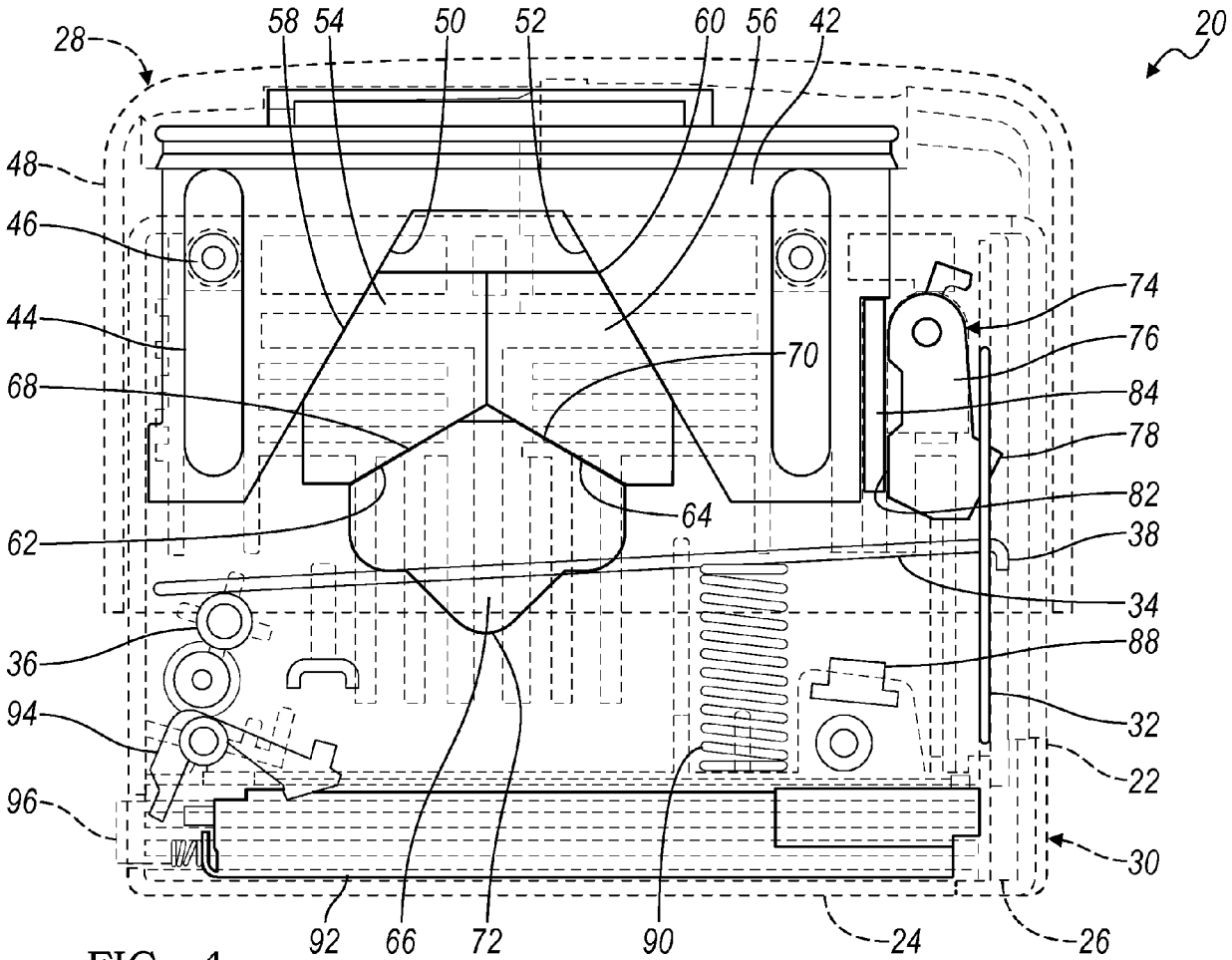
FIG. 4 is another section view of the fastening tool assembly of FIG. 1 illustrated in a loaded position.

With continued reference to FIGS. 2-4, a load spring 34 is mounted in the housing 22. The load spring 34 is a leaf spring and engages a fulcrum 36 at one end in the housing 22. Of course, any type of biasing member is contemplated. The load spring 34 has a free end 38 that extends into an aperture 40 in the knife 32 for driving the knife 32. Loading of the load spring 34 biases the knife 32 to the release position.

The handle 28 includes a carriage 42 with a pair of slots 44 that receive bosses 46 of the housing 22. The carriage 42 translates relative to the housing 22 due to the engagement of the slots 44 and the bosses 46. The handle 28 also includes a shroud 48 mounted to the carriage 42 and extending partially over the housing 22. A pair of inwardly converging ramp surfaces 50, 52 is formed upon the carriage 42, facing the housing 22. A pair of wedges 54, 56 having corresponding inclined surfaces 58, 60 that engage the ramp surfaces 50, 52. The pair of wedges 54, 56 each also has another inclined surface 62, 64 facing the load spring 34. A third wedge 66 is provided with a pair of inclined surfaces 68, 70 in engagement with the inboard facing inclined surfaces 62, 64 of the pair of wedges 54, 56. The third wedge 66 includes a central fulcrum 72 that engages the load spring 34.

The tool assembly 20 includes a release mechanism 74 that retains the knife 32 in the latched position depicted in FIGS. 3-6. As the handle 28 is translated toward the housing 22, the pair of wedges 54, 56 converges as depicted in FIG. 4. As the pair of wedges 54, 56 converges, the third wedge 66 is translated toward the magazine assembly 30, thereby deforming and loading the load spring 34.

The release mechanism 74 includes a latch member 76 pivotally connected to the housing 22. A catch 78 extends from the latch member 76 into an aperture 80 in the knife 32 to retain the knife 32 in the latched position. A cam portion 82 of the latch member 76 engages a slider 84, which prevents rotation of the latch member 76 in the latched position. The slider is mounted for translation in the housing 22, and includes an aperture 86 aligned to receive the cam portion 82 of the latch member 76.

In the intermediate depressed position of the handle 28 in FIG. 4, the carriage 42 engages the slider 84. Further depression of the handle 28 translates the slider 84 as illustrated in FIGS. 6 and 7, thereby aligning the slider aperture 86 with the cam portion 82. The latch member 76 thereby rotates the cam portion 82 into the slider aperture 86, which withdraws the catch 78 from the knife aperture 80, and releases the knife 32. Release of the knife 32 releases the stored load on the load spring 34 causing the load spring 34 to drive the knife 32 into an end fastener on the magazine, thereby shearing the end fastener from a sequential fastener if applicable, and driving the fastener out of the outlet 26 and into the workpiece. At an end of a range of travel of the leaf spring 34, the leaf spring 34 impacts a damping pad 88 in the housing 22.

A return spring 90 is provided in the housing 22 in engagement with the load spring 34. The return spring 90 is compressed by the firing of the load spring 34; and then expands to return the load spring 34 to a raised position (FIGS. 2-4), thereby also raising the knife 32, and the third wedge 66. As the third wedge 66 is raised, the pair of wedges 54, 56 diverges and raises the handle 28. As the knife 32 is raised, the load spring 34 raises the slider 84 thereby pivoting the cam portion 82 of the latch member 76 out of the aperture 86 for pivoting the catch 78 into the knife aperture 80. Likewise, the slider 84 prevents the latch member 76 from releasing the knife 32.

Figure 8:
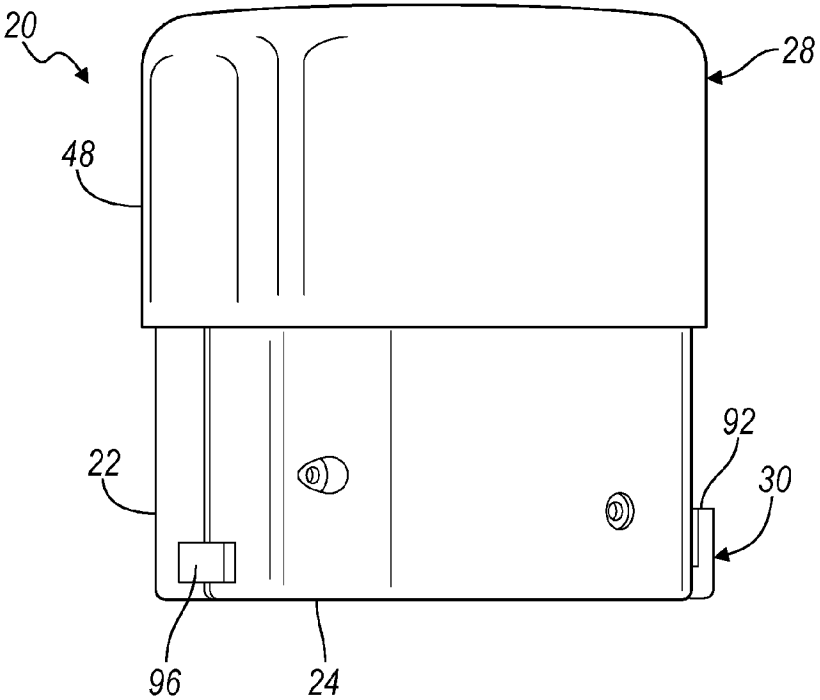
FIG. 8 is a rear perspective view of the fastening tool assembly of FIG. 1.
Figure 9:
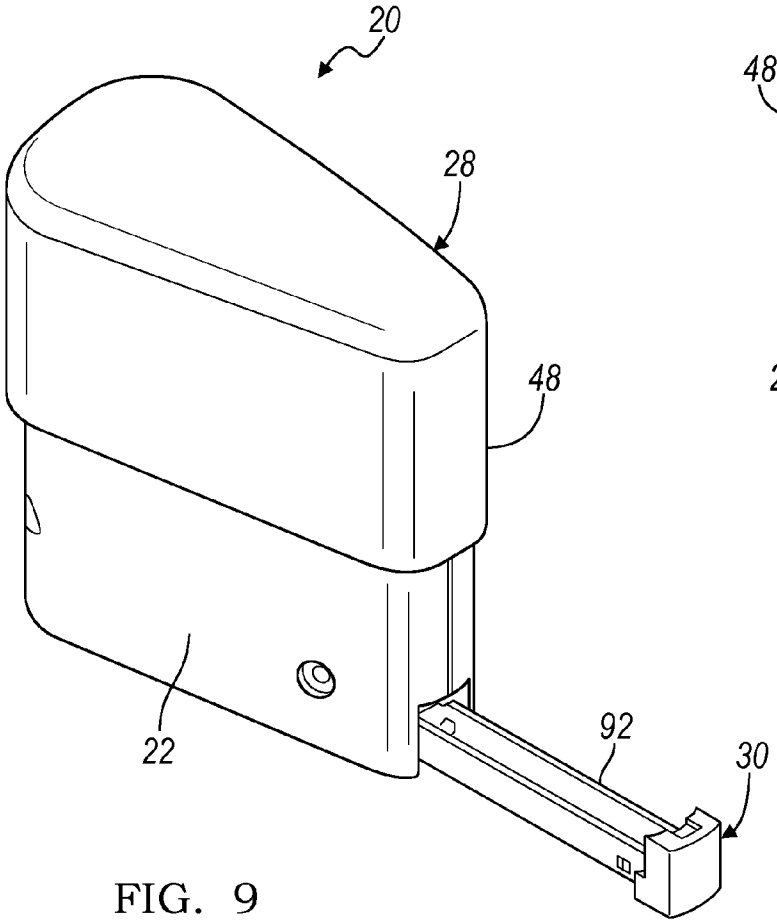
FIG. 9 is another front perspective view of the fastening tool assembly of FIG. 1, illustrated with a magazine in an extended position.

FIGS. 7-9 depict that the magazine assembly 30 includes a magazine 92 that is mounted for translation in the housing 22 for extension (FIG. 9) from the housing 22 adjacent the fastener outlet 26 to receive fasteners. Another latch member 94 may be pivotally mounted in the housing 22 in engagement with the magazine 92 to retain the magazine 92 within the housing 22. A button 96 may be mounted on the housing 22 spaced apart from the outlet 26 so that manual depression of the button 96 pivots the latch member 94 out of engagement from the magazine 92 to extend the magazine 92.

Figure 10:
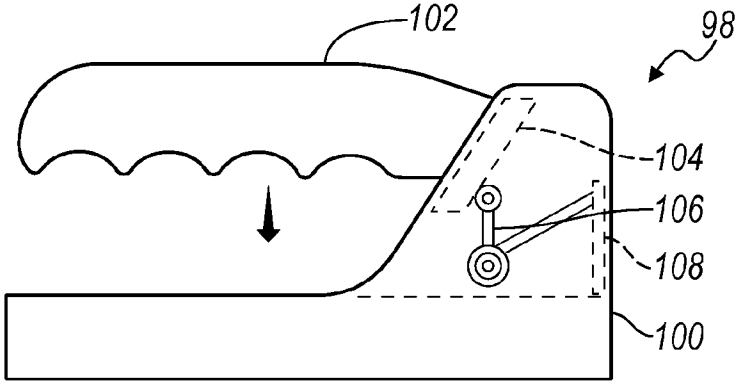
FIG. 10 is a side elevation view of a fastening tool assembly according to another embodiment.

FIG. 10 illustrates a fastening tool assembly 98 according to another embodiment with a housing 100 and a handle 102. Translation of the handle 102 towards the housing 100 causes a ramp surface 104 to engage and load a torsion spring 106 that drives a knife 108 upon release.

Figure 11:
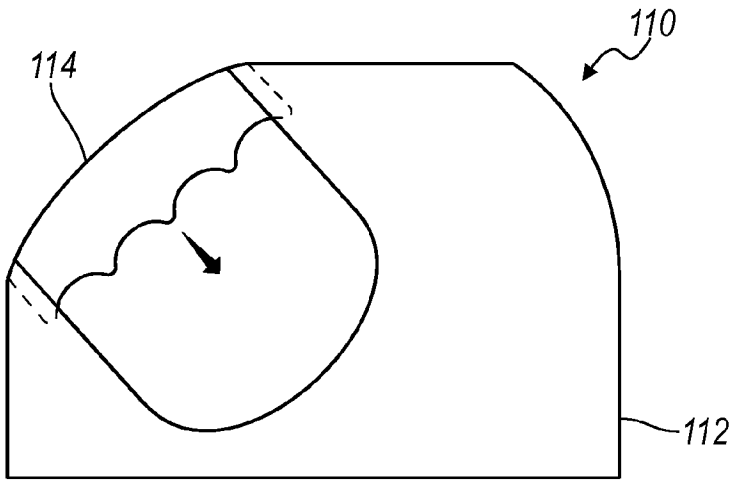
FIG. 11 is a side elevation view of a fastening tool assembly according to yet another embodiment.

FIG. 11 depicts another fastening tool assembly 110 with another configuration of a housing 112 and a handle 114, which may employ mechanisms according to any of the other embodiments.

Figure 12:
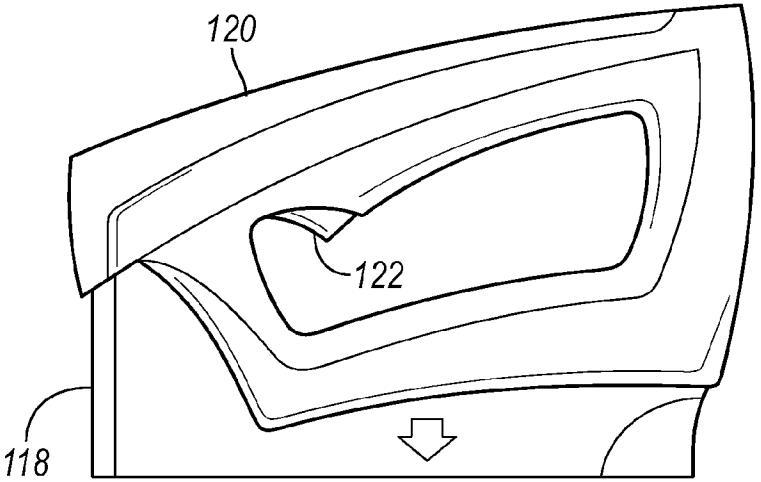
FIG. 12 is a side elevation view of a fastening tool assembly according to another embodiment.

FIG. 12 includes another fastening tool assembly 116 with a housing 118 and a handle 120. A trigger 122 may be provided for actuating a release mechanism once the handle 120 is depressed.

Figure 14:
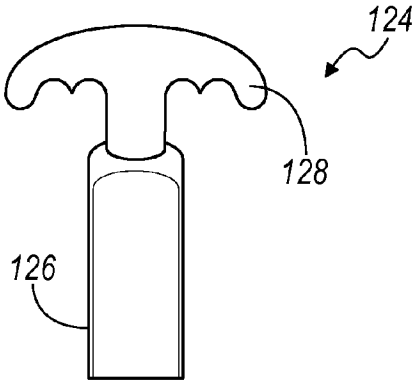
FIG. 14 is a front elevation view of the fastening tool assembly of FIG. 13.
Figure 13:
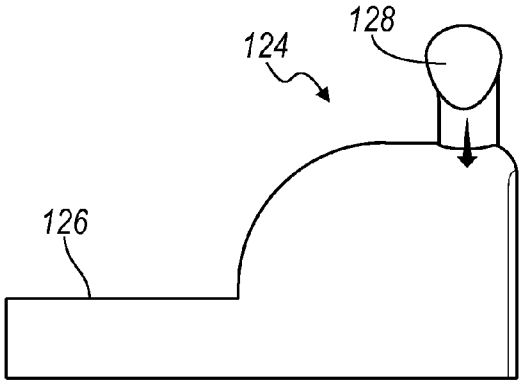
FIG. 13 is a side elevation view of a fastening tool assembly according to yet another embodiment.

FIGS. 13 and 14 illustrate a fastening tool assembly 124 with a housing 126 and a dual handle 128 for receiving additional input force from the user. The fastening tool assembly 124 may employ mechanisms according to the teachings of other embodiments.

Figure 16:
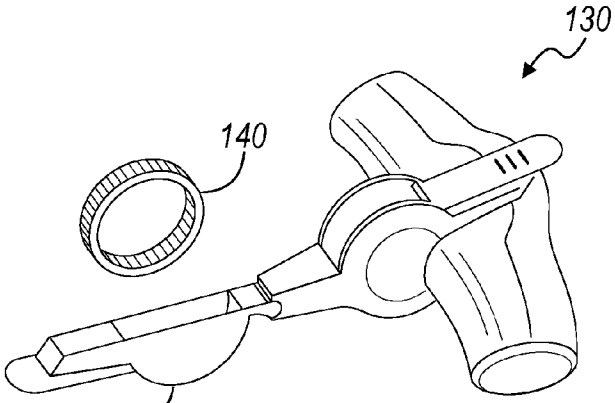
FIG. 16 is a partially exploded perspective view of the fastening tool assembly of FIG. 15.
Figure 15:
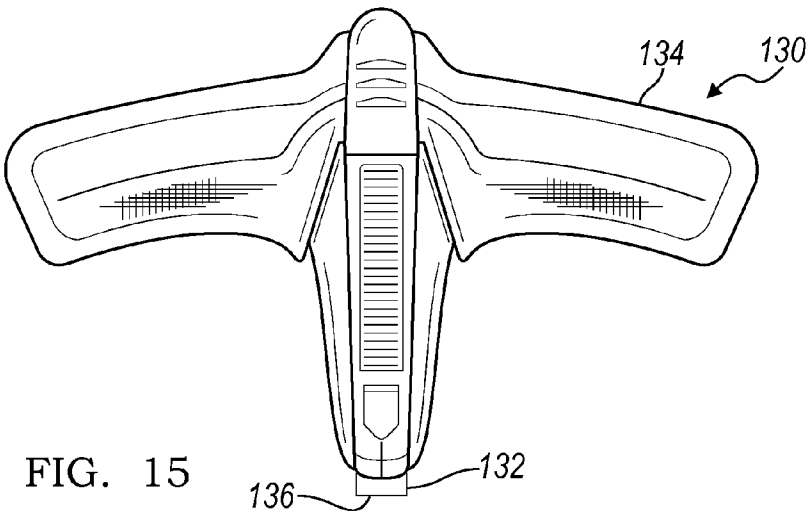
FIG. 15 is a front elevation view of a fastening tool assembly according to another embodiment.

FIGS. 15 and 16 illustrate another fastening tool assembly 130 with a housing 132 and a dual handle 134. A contact surface 136 is smaller than prior embodiments for use in applications where a flat reaction surface on the workpiece is not typical. The tool assembly 130 may include a cover 138 for receipt of a fastener cartridge 140. The tool assembly 130 may also utilize the teachings of other embodiments for the driving the fastener.

Figure 18:
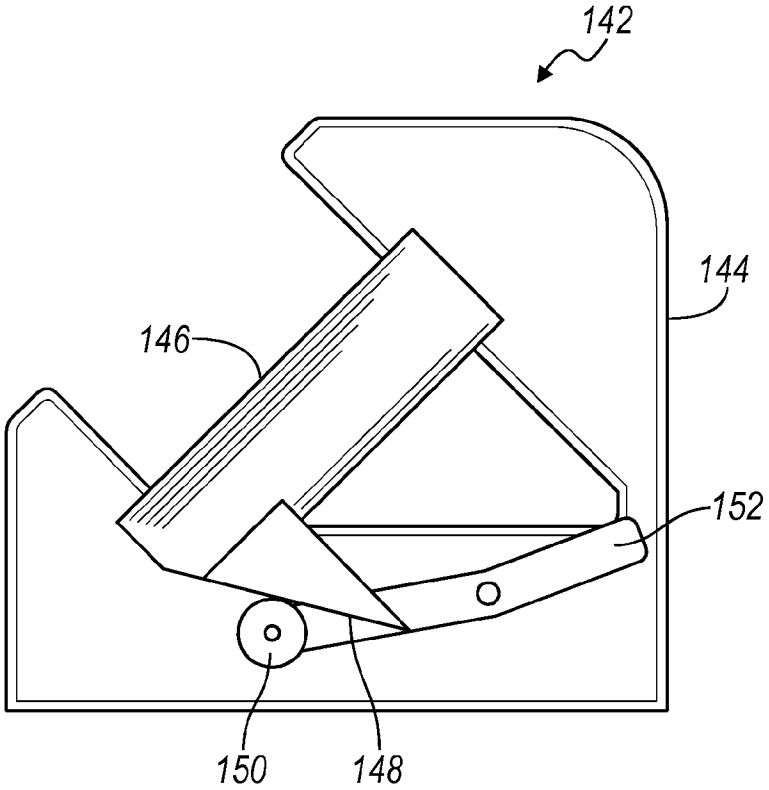
FIG. 18 is another schematic view of the fastening tool assembly of FIG. 17, illustrated in a loaded position.
Figure 17:
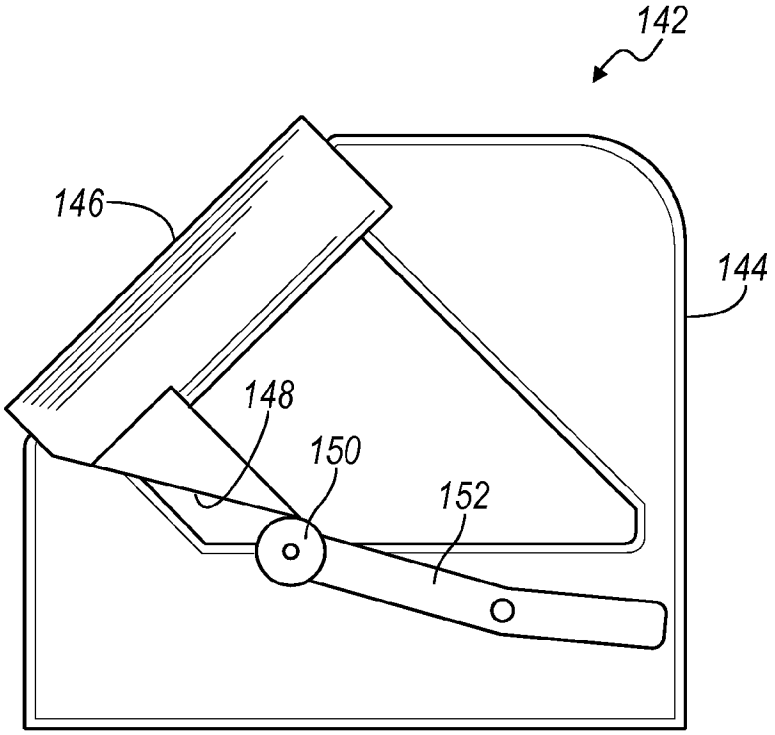
FIG. 17 is schematic view of a fastening tool assembly according to yet another embodiment, illustrated in an unloaded position.

FIGS. 17 and 18 depict a fastening tool assembly 142 with a housing 144 and a handle 146. The handle 146 includes a ramp surface 148 in contact with a follower 150 on a lever 152 for loading a load spring and releasing a knife.

While various embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A fastening tool assembly comprising:

a housing having a contact surface to contact a workpiece, and a fastener outlet provided along the contact surface to dispense fasteners therethrough;

a magazine mounted in the housing to store fasteners and to convey the fasteners to the fastener outlet;

a knife mounted in the housing for translation relative to the outlet for a latched position and a release position to drive a fastener from the magazine through the outlet during translation to the release position;

a biasing member mounted in the housing and operably connected to the knife to bias the knife to the release position;

a handle mounted to the housing to translate relative to the housing, the handle being operably connected to the knife and the biasing member to load the biasing member and release the knife and the biasing member, thereby permitting the biasing member to return the knife to the release position to consequently drive a fastener through the outlet;

wherein the handle does not pivot relative to the housing;

wherein translation of the handle toward the housing loads the biasing member;

a pair of inwardly converging ramp surfaces formed upon the handle facing the housing; and a pair of wedges engaging the ramp surfaces and cooperating with the biasing member to each translate laterally inboard to converge as the handle is translated toward the housing.

2. The fastening tool assembly of claim 1 further comprising a third wedge engaging the pair of wedges and the biasing member to translate toward the housing thereby loading the biasing member as the pair of wedges converge.

3. The fastening tool assembly of claim 1 wherein the biasing member is further defined as a first biasing member; and wherein the fastening tool assembly further comprises a second biasing member biasing the knife to a raised position.

4. The fastening tool assembly of claim 3 wherein the second biasing member engages the first biasing member and the housing.

5. The fastening tool assembly of claim 3 further comprising a release mechanism mounted to the housing to retain the knife in the raised position, wherein the handle actuates the release mechanism in a depressed position to release the knife.

6. The fastening tool assembly of claim 5 wherein the knife includes an aperture formed therethrough; and wherein the release mechanism further comprises a latch member pivotally connected to the housing with a catch extending into the knife aperture to retain the knife in the raised position.

7. The fastening tool assembly of claim 6 further comprising:

a cam portion provided on the latch member spaced apart from the catch; and a slider mounted for translation in the housing in engagement with the latch member cam portion, the slider having an aperture formed therethrough, the slider cooperating with the handle so that depression of the handle translates the slider until the slider aperture aligns with the latch member cam portion whereby the latch member pivots as the cam portion extends into the slider aperture thereby releasing the catch from the knife thereby releasing the knife.

8. The fastening tool assembly of claim 7 further comprising a third wedge engaging the pair of wedges and the biasing member to translate toward the housing thereby loading the biasing member as the pair of wedges converge; and wherein upon removal of a manual force from the handle, the second biasing member biases the first biasing member to the raised position, consequently translating the knife to the raised position, and translating the third wedge to a raised position consequently diverging the pair of wedges and consequently raising the handle, and engaging and translating the slider to a raised position consequently pivoting the latch member catch into engagement with the knife aperture.

9. The fastening tool assembly of claim 7 wherein the slider is mounted for linear translation only in the housing.

10. The fastening tool assembly of claim 1 wherein the magazine is mounted for translation in the housing for extension from the housing to receive fasteners;

wherein the fastening tool assembly further comprises:

a latch member pivotally connected to the housing in engagement with the magazine to retain the magazine within the housing; and a button mounted on the housing wherein depression of the button pivots the latch member out of engagement from the magazine to extend the magazine.

11. The fastening tool assembly of claim 10 wherein the magazine extends from the housing on an opposed surface than a location of the button.

12. A fastening tool assembly comprising:

a housing having a contact surface to contact a workpiece, and a fastener outlet provided along the contact surface to dispense fasteners therethrough;

a magazine mounted in the housing to store fasteners and to convey the fasteners to the fastener outlet;

a knife mounted in the housing for translation relative to the outlet for a latched position and a release position to drive a fastener from the magazine through the outlet during translation to the release position;

a biasing member mounted in the housing and operably connected to the knife to bias the knife to the release position;

a handle mounted to the housing to move relative to the housing, the handle being operably connected to the knife and the biasing member to load the biasing member and release the knife and the biasing member, thereby permitting the biasing member to return the knife to the release position to consequently drive a fastener through the outlet, with a pair of inwardly converging ramp surfaces formed upon the handle facing the housing;

a pair of wedges engaging the ramp surfaces and cooperating with the biasing member to converge as the handle is translated toward the housing; and a third wedge engaging the pair of wedges and the biasing member to translate toward the housing thereby loading the biasing member as the pair of wedges converge.

13. The fastening tool assembly of claim 12 wherein the biasing member is further defined as a first biasing member; and wherein the fastening tool assembly further comprises a second biasing member biasing the knife to a raised position.

14. The fastening tool assembly of claim 13 further comprising a release mechanism mounted to the housing to retain the knife in the raised position, wherein the handle actuates the release mechanism in a depressed position to release the knife.

15. The fastening tool assembly of claim 14 wherein the knife includes an aperture formed therethrough; and wherein the release mechanism further comprises a latch member pivotally connected to the housing with a catch extending into the knife aperture to retain the knife in the raised position.

16. The fastening tool assembly of claim 15 further comprising:

a cam portion provided on the latch member spaced apart from the catch; and a slider mounted for translation in the housing in engagement with the latch member cam portion, the slider having an aperture formed therethrough, the slider cooperating with the handle so that depression of the handle translates the slider until the slider aperture aligns with the latch member cam portion whereby the latch member pivots as the cam portion extends into the slider aperture thereby releasing the catch from the knife thereby releasing the knife.

17. The fastening tool assembly of claim 16 wherein the slider is mounted for linear translation only in the housing.

18. The fastening tool assembly of claim 12 wherein the pair of wedges translate laterally inboard to converge.

19. A fastening tool assembly comprising:

a housing having a contact surface to contact a workpiece, and a fastener outlet provided along the contact surface to dispense fasteners therethrough;

a magazine mounted in the housing to store fasteners and to convey the fasteners to the fastener outlet;

a knife mounted in the housing for translation relative to the outlet for a latched position and a release position to drive a fastener from the magazine through the outlet during translation to the release position, wherein the knife includes an aperture formed therethrough;

a first biasing member mounted in the housing and operably connected to the knife to bias the knife to the release position;

a handle mounted to the housing to move relative to the housing, the handle being operably connected to the knife and the first biasing member to load the first biasing member and release the knife and the first biasing member, thereby permitting the first biasing member to return the knife to the release position to consequently drive a fastener through the outlet;

a second biasing member biasing the knife to a raised position;

a latch member pivotally connected to the housing with a catch extending into the knife aperture to retain the knife in the raised position;

a cam portion provided on the latch member spaced apart from the catch; and a slider mounted for linear translation only in the housing in engagement with the latch member cam portion, the slider having an aperture formed therethrough, the slider cooperating with the handle so that depression of the handle translates the slider until the slider aperture aligns with the latch member cam portion whereby the latch member pivots as the cam portion extends into the slider aperture thereby releasing the catch from the knife thereby releasing the knife.

20. The fastening tool assembly of claim 19 wherein upon removal of a manual force from the handle, the second biasing member biases the first biasing member to the raised position, consequently translating the knife to the raised position, raising the handle, and engaging and translating the slider to a raised position consequently pivoting the latch member catch into engagement with the knife aperture.

* * * * *